US006504088B1

(12) United States Patent
Hsieh

(10) Patent No.: US 6,504,088 B1
(45) Date of Patent: Jan. 7, 2003

(54) STAND STRUCTURE OF A STRIKING MECHANISM FOR A BASS DRUM

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 12 days.

(21) Appl. No.: 09/897,977

(22) Filed: Jul. 5, 2001

(51) Int. Cl.[7] ..... G10D 13/02
(52) U.S. Cl. ..... 84/422.1; 821/422.2; 821/422.3
(58) Field of Search ..... 84/422.1, 422.2, 84/422.3

(56) References Cited

U.S. PATENT DOCUMENTS 6,188,007 B1 * 2/2001 Liao ..... 84/422.1

* cited by examiner

*Primary Examiner*—Shih-Yung Hsieh
(74) *Attorney, Agent, or Firm*—Fei-Fei Chao; Venable, Baetjer, Howard & Civiletti, LLP

(57) ABSTRACT

A standing structure of a striking mechanism for a bass drum includes a base plate with two arms extending from the base plate. Each of the two arms has a first recess defined thereon to receive a barrel having bearing inside. Two retaining caps are connected together by a connecting rod, and each retaining cap has a second recess corresponding to the first recess defined thereon. The barrels can be force fitted and clamped in the combined first recess and the second recess, and the bearings in the barrels can be connected to a long shaft and a short shaft. The standing structure can enhance the stability of a strike of the bass drum, the precision when assembling the stand structure, and is suitable for a left-footed or a right-footed person to play the bass drum.

5 Claims, 8 Drawing Sheets

STAND STRUCTURE OF A STRIKING MECHANISM FOR A BASS DRUM

BACKGROUND OF THE INVENTION

1. Field of the Invention

The present invention relates to a stand structure, and more particularly to a stand structure of a striking mechanism for a bass drum which can enhance both the stability of a strike of the bass drum and the precise assembly of the stand structure, and which is suitable for a left-footed or a right-footed person to play the bass drum.

2. Description of Related Art

Playing drums has been popular for thousands of years and devices for striking the drums have developed from hands and animal bones to sophisticated striking mechanisms. In particular, the development of the foot pedal for a bass drum has enabled a player to play several different drums simultaneously, whereby considerable advances in technique have become possible. Despite those advances, one problem has remained consistent, which is, although most people are right-footed some are left-footed. This discrepancy means that foot pedals must be manufactured to meet both types of player, but the small quantity of left-footed player relative to the right-footed players, means it is uneconomic to produce foot pedals for the former. For example, with reference to FIGS. 6 and 7, a conventional striking mechanism for a bass drum is shown and arranged to be suitable for a right-footed player. The striking mechanism includes a right-stand (60R) and a left-stand (60L) formed as a pair and corresponding to the left-foot and the right-foot of a player. The right stand (60R) has a first shaft (61) and a second shaft (62) coupled to a first mallet linkage (64) and a second mallet linkage (65), respectively, to drive two mallets (not shown). A right driven linkage (68) is coupled to the first shaft (61) and linked to a right-pedal (67) by a first chain (66). Therefore, when the player steps with his right foot on the right-pedal (67), a connection of the first chain (66), the right driven linkage (68), and the first mallet linkage (64) will drive the mallet to strike the bass drum (not shown).

The left-stand (60L) has a third shaft (63) and a second driven linkage (71) coupled to the third shaft (63). The second driven linkage (71) is linked to a left-pedal (70) by a second chain (69). The second shaft (62) and the third shaft (63) are coupled together by a connecting shaft (72) such that when the player steps on the left-pedal (70), the second mallet linkage (65) will drive the mallet to strike the bass drum. Referring specifically to FIG. 7, in order for the first and second shafts (61 and 62) to rotate smoothly and for these two shafts (61 and 62) to be supported, a bracket (77) and two sets of bearings (73, 74 and 75, 76) are provided. The bracket (77) is securely connected to the right-stand (60R) and has another end mounted with the bearings (74 and 75) corresponding to the first and second shafts (61 and 62).

With reference to FIG. 8, another conventional stand structure is shown and having a similar structure to that of the first prior art. A first mallet linkage (68') firmly engages with the first shaft (61) and the bearing (74) corresponding to the second shaft (62) is disposed inside the first mallet linkage (68'). This conventional stand structure, in FIG. 8, has fewer components and is easier to assemble than the previous stand structure but still shortcomings arise from that the first and second shafts (61 and 62) are only supported on one end of each first and second shafts (61 and 62).

When a mallet strikes the bass drum, the shafts (61 and 62) will vibrate due to the lack of good support and this vibration effects the stability of the stand structure.

Furthermore, the two conventional stand structures mentioned are only suitable for a right-footed person and can not be rearranged to suit a left-footed person because the components are produced as right-footed versions and are not symmetric. Components of the stand structure must be replaced to suit a left-footed person which will increase the cost and complexity of manufacture.

To overcome the shortcomings, the present invention tends to provide an improved stand structure of a striking mechanism for a bass drum to mitigate or obviate the aforementioned problems.

SUMMARY OF THE INVENTION

The objective of the present invention is to provide a stand structure of a striking mechanism for a bass drum which can enhance the stability of a strike operation of the bass drum.

Another objective of the present invention is to provide a stand structure of a striking mechanism for a bass drum which can enable precise assembly of the stand structure.

Another objective of the present invention is to provide a stand structure of a striking mechanism for a bass drum which can be easily rearranged to suit either a left-footed player or a right-footed player.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
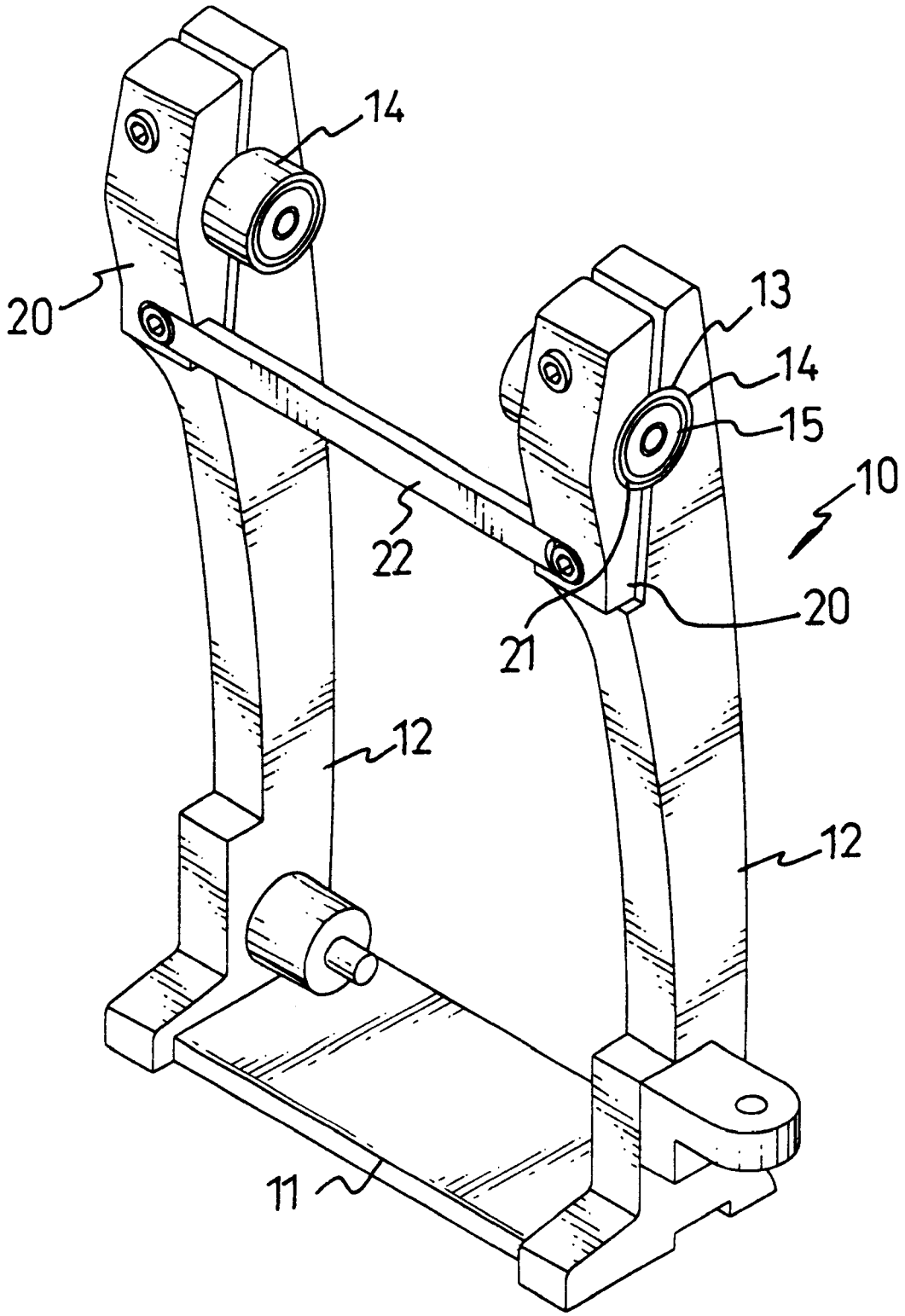
FIG. 1 is a perspective view of a stand structure of a striking mechanism for a bass drum in accordance with the present invention.
Figure 2:
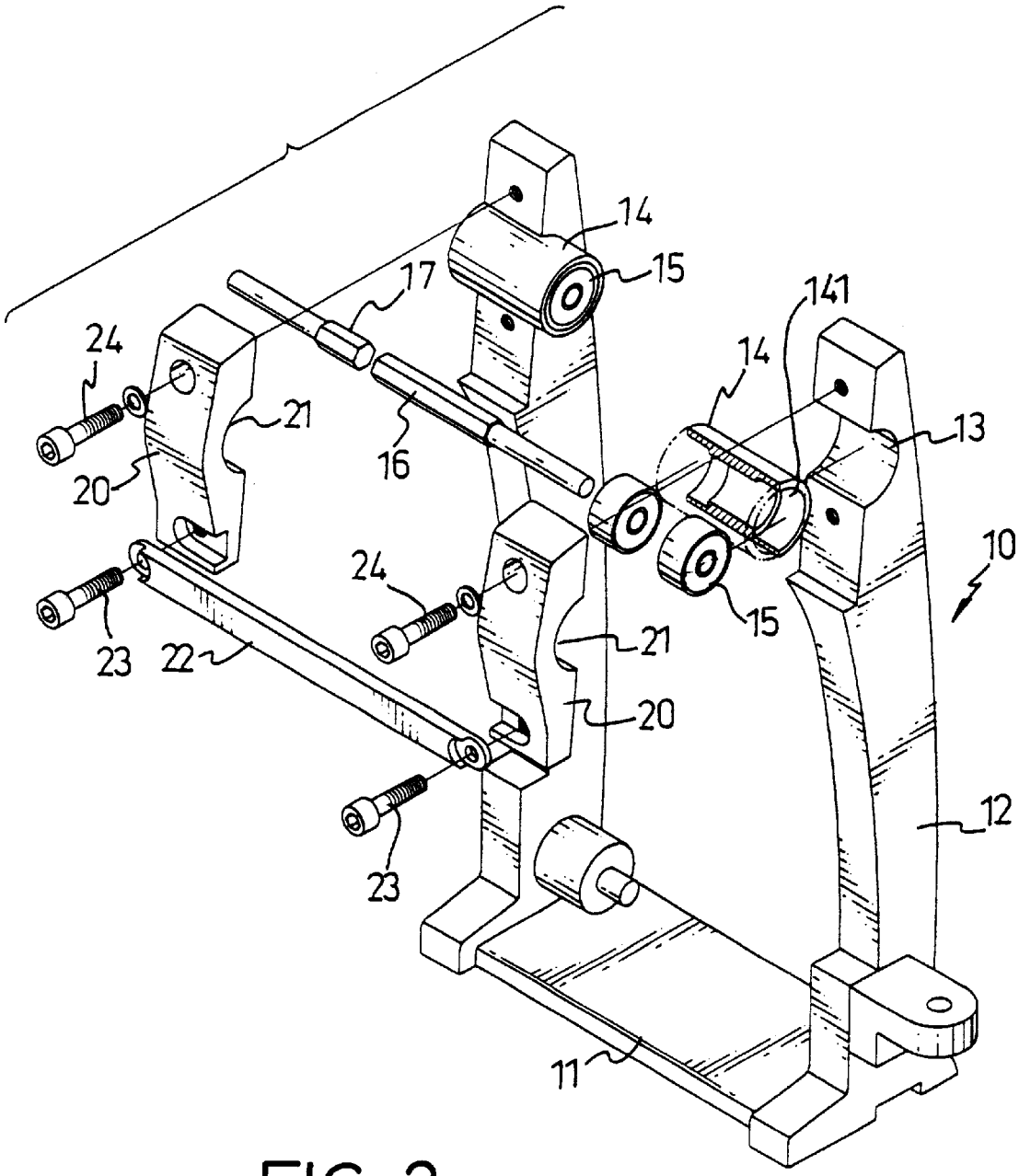
FIG. 2 is an exploded, perspective view of the stand structure of the striking mechanism for the bass drum.

With reference to FIGS. 1 and 2, a stand structure (10) of a striking mechanism for a bass drum in accordance with the present invention has a base plate (11) and two arms (12) separately extending upward from two lateral sides of the base plate (11). Each arm (12) has a first recess (13) defined in an upper portion of the arm (12). The recesses (13) are so configured that two barrels (14) can be respectively force fitted inside with half of the barrel (14) protruding from the first recess (13). The barrels (14) each has two receiving end portions (141 ) defined inside corresponding to two bearings (15) such that the bearings (15) can be force fitted in the respective receiving end portions (141). A long shaft (16)

and a short shaft (17) are disposed between the barrels (14) and connected respectively to the bearings (15).

Two retaining caps (20) each has a second recess (21) defined therein. The recess (21) is configured corresponding to the remaining half of the barrel (14) that protrudes from the first recess (13). The two retaining caps (20) are further held in place by an elongated connecting rod (22) securely extending between the caps (20).

When assembling the stand structure (10), the bearings (15) are force fitted in the corresponding receiving end portions (141) of the barrels (14). The retaining caps (20) each is disposed on the corresponding upper portion of the arm (12) with each barrel (14) received in the first recess (13) and the second recess (21). The connecting rod (22) is disposed between the retaining caps (20) to connect the retaining caps (20) together. Two bottom screws (23) are used to securely connect the connecting rod (22) between the retaining caps (20) and further mount the retaining caps (20) to the arms (12). Two top screws (24) are used to mount the retaining caps (20) to the arms (12).

Figure 3:
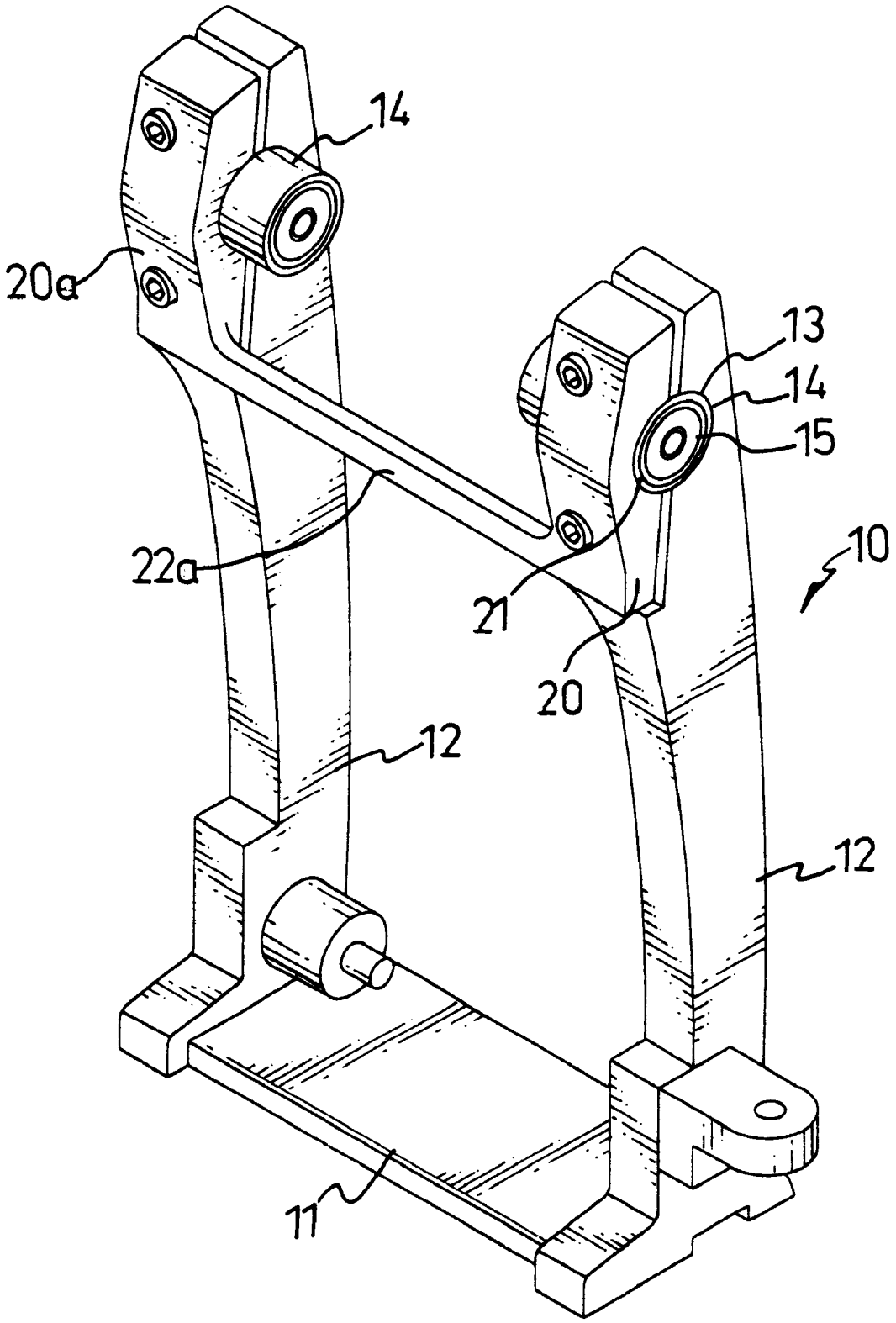
FIG. 3 is a perspective view of another preferred embodiment of the present invention.

With reference to FIG. 3, another preferred embodiment is shown. In this preferred embodiment, the connecting rod (22*a*) is integrally formed on the two retaining caps (20*a*), and the remaining components are the same as the previous embodiment thus excessive description is omitted.

Figure 4:
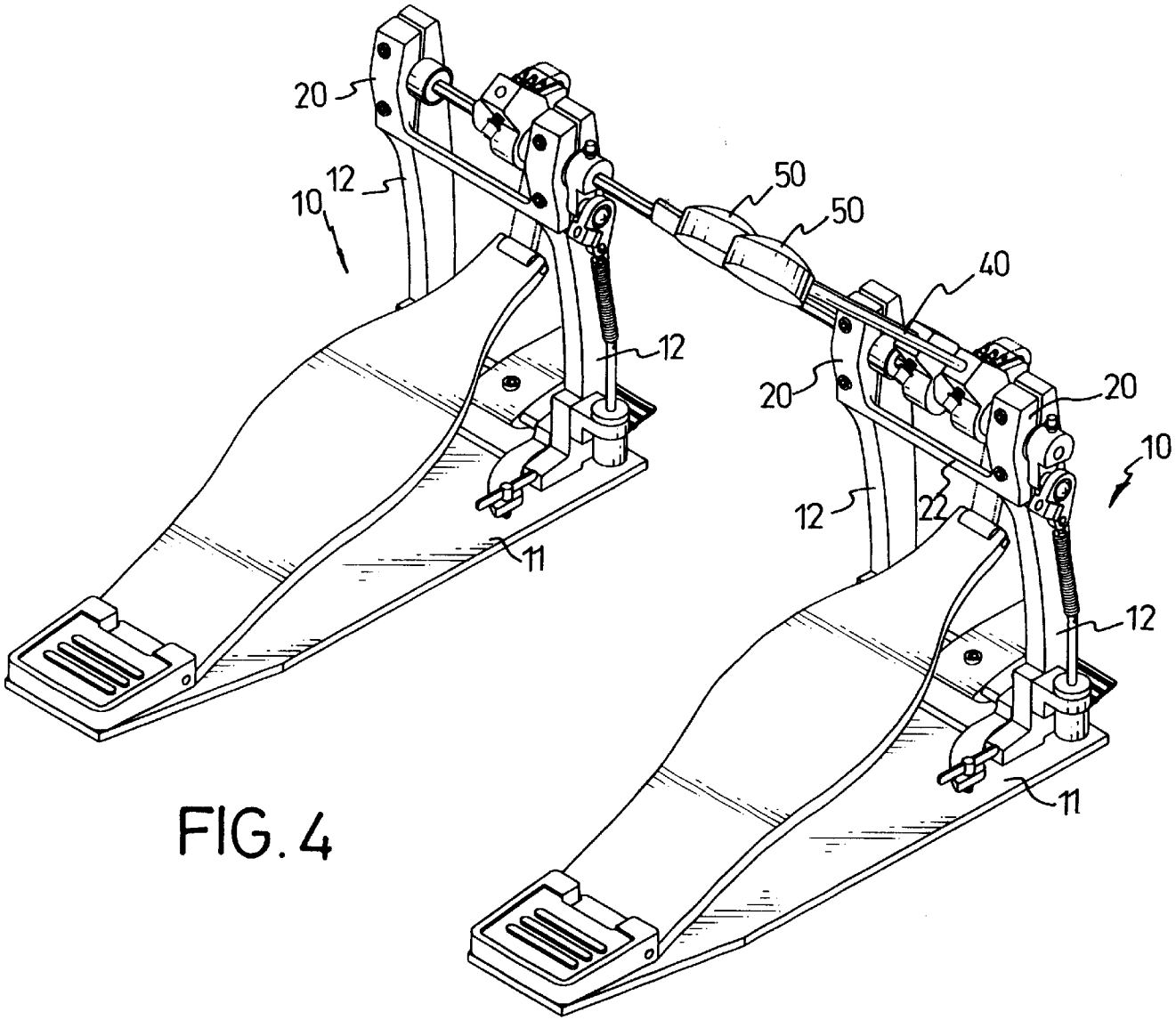
FIG. 4 is a perspective view of a striking mechanism with the stand structure and arranged for a right-foot player.
Figure 5:
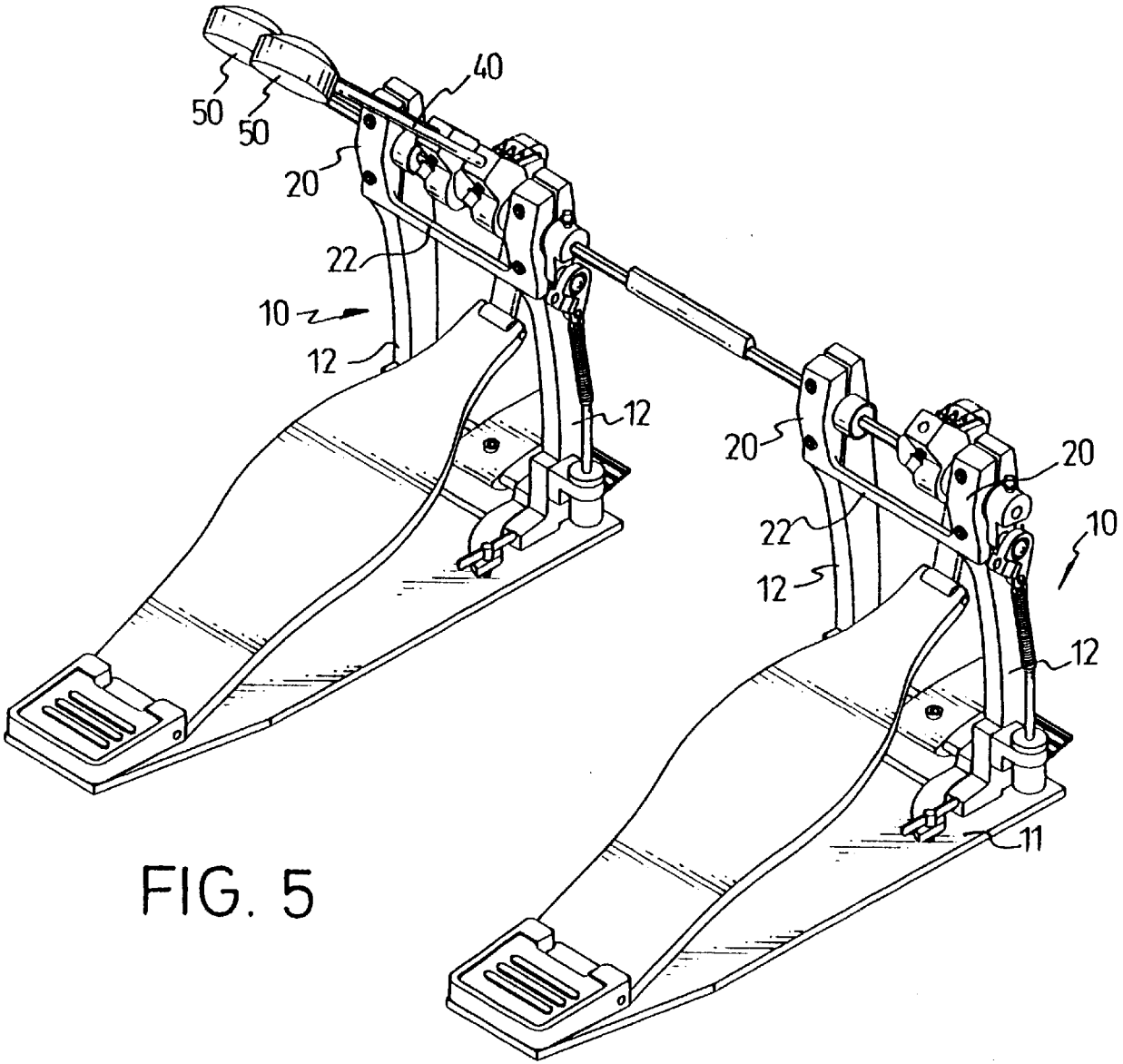
FIG. 5 is a perspective view of a striking mechanism with the stand structure and arranged for a left-foot player.
Figure 6:
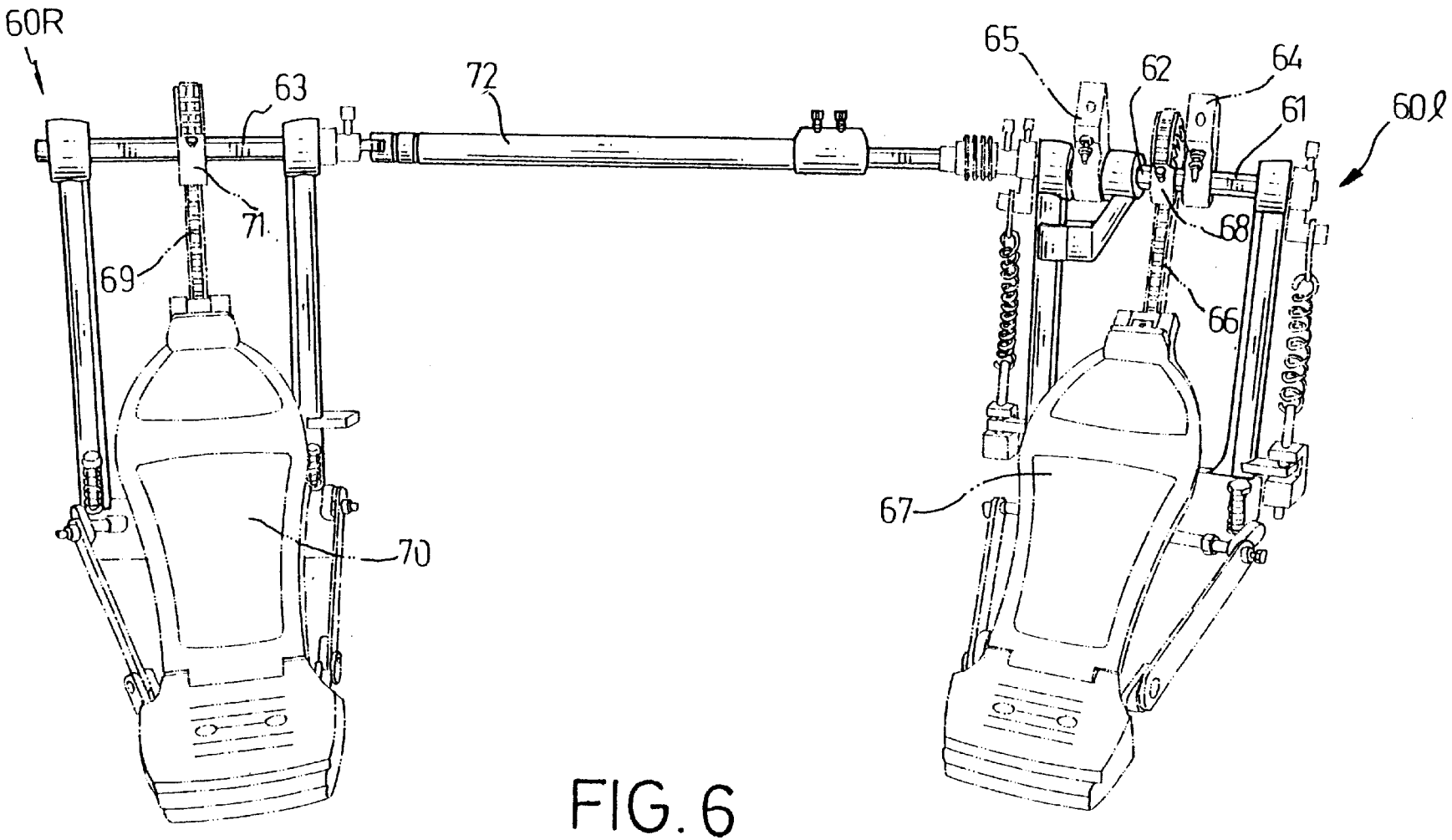
FIG. 6 PRIOR ART
FIG. 6 is a perspective view of a conventional striking mechanism for a bass drum.
Figure 7:
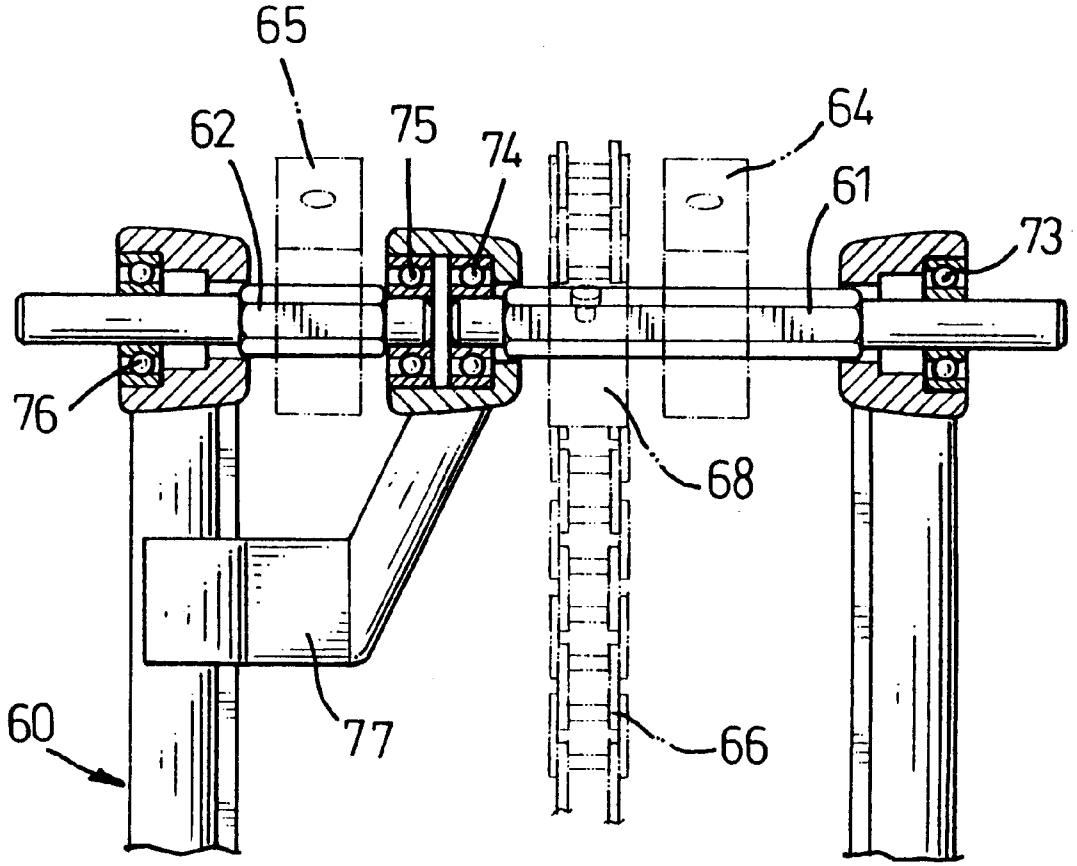
FIG. 7 PRIOR ART
FIG. 7 is a cross-sectional view of a conventional stand structure.
Figure 8:
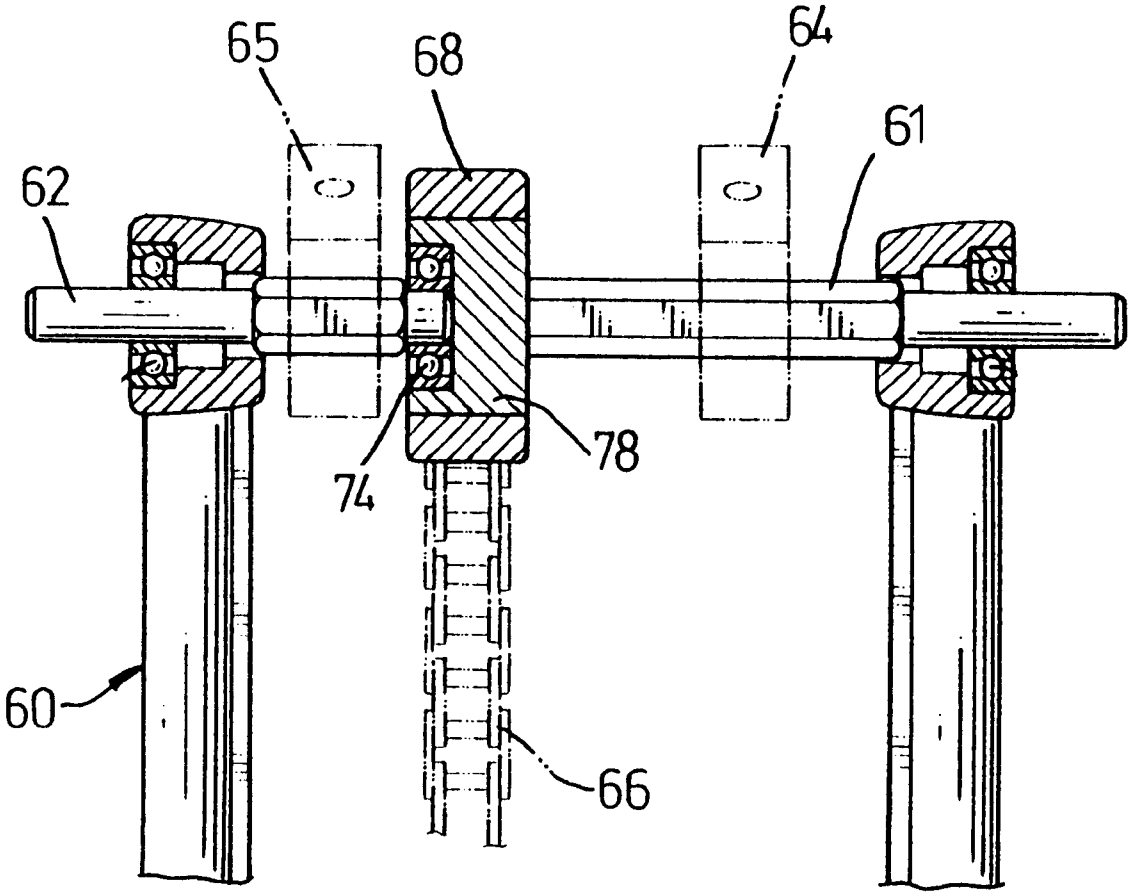
FIG. 8 PRIOR ART
FIG. 8 is a cross-sectional view of another conventional stand structure.

With reference to FIGS. 4 and 5, a different arrangement of the stand structures (10) can be made in order to suit a right-footed or a left-footed person. FIG. 4 shows the stand structures (10) arranged to suit a right-footed person and the stand structure (10) is adapted to two mallets (40 and a connecting shaft (30). The two mallets (40) are separately connected to the long shaft (16) and short shaft (17) of the stand structure (10). In FIG. 5, the stand structures (10) are rearranged by exchanging the relative position of the long shaft (16) and the short shaft (17) to suit a left-footed person.

From the above description, it is noted that the invention has the following advantages:

1. enhanced stability. The barrels (14) are securely clamped between the retaining caps (20) and the arms (12), thus the stability of the stand structure (10) is enhanced.
2. improved precision. The connecting rod (22) used to securely connect the two retaining caps (20) can improve the precise assembly of the stand structure.
3. suitability for both right-footed and left-footed persons. The stand structure (10) can be easily arranged to suit a right-footed or a left-footed person by simply exchanging the relative position of the long shaft (16) and the short shaft (117).

The present invention relates to a stand structure, and more particularly to a stand structure of a striking mechanism for a bass drum which can enhance both the stability of a strike of the bass drum, and the precision when assembling the stand structure, and is further suitable for a left-footed or a right-footed person to play the bass drum.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stand structure of a striking mechanism for a bass drum, the stand structure comprising:

a base plate;

multiple arms extending from the base plate, and each arm having a first recess;

multiple retaining caps respectively and securely mounted on the multiple arms, and the multiple retaining caps each having a second recess corresponding to the first recess;

multiple barrels each with at least one bearing securely received inside the barrel, wherein the multiple barrels each is force fitted and clamped in the first recess and the second recess;

a long shaft and a short shaft respectively and removably connected to a corresponding one of the bearings in the barrels; and at least one connecting rod to securely connect the multiple retaining caps together.

2. The standing structure as claimed in claim 1, wherein the at least one connecting rod is integrally formed on the multiple retaining caps.

3. The standing structure as claimed in claim 1, wherein the multiple retaining caps are mounted on the multiple arms by screws extending through the caps and the arms.

4. The standing structure as claimed in claim 2, wherein the multiple retaining caps are mounted on the multiple arms by screws extending through the caps and the arms.

5. The standing structure as claimed in claim 1, wherein the connecting rod threadingly connects the multiple retaining caps together.

* * * * *